US006249766B1

(12) United States Patent
Wynblatt et al.

(10) Patent No.: US 6,249,766 B1
(45) **Date of Patent: *Jun. 19, 2001**

(54) REAL-TIME DOWN-SAMPLING SYSTEM FOR DIGITAL AUDIO WAVEFORM DATA

(75) Inventors: Michael J. Wynblatt, Robbinsville; Stuart Goose, Princeton, both of NJ (US)

(73) Assignee: Siemens Corporate Research, Inc., Princeton, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/037,950

(22) Filed: Mar. 10, 1998

(51) Int. Cl.[7] ..... G10L 21/00
(52) U.S. Cl. ..... 704/503; 704/211; 708/290
(58) Field of Search ..... 704/211, 216, 704/265, 500–504; 708/290, 313

(56) References Cited

U.S. PATENT DOCUMENTS

| | | | | |
|---|---|---|---|---|
| 5,111,505 | * | 5/1992 | Kitoh et al. | 704/265 |
| 5,341,432 | * | 8/1994 | Suzuki et al. | 704/216 |
| 5,398,029 | * | 3/1995 | Toyama et al. | 708/290 |
| 5,453,741 | * | 9/1995 | Iwata | 708/290 |
| 5,621,404 | * | 4/1997 | Heiss et al. | 708/290 |

* cited by examiner

*Primary Examiner*—David D. Knepper
(74) *Attorney, Agent, or Firm*—Donald B. Paschburg

(57) ABSTRACT

A down-sampling system for digital waveforms performs real-time, "on the fly", conversions and results in data of acceptable quality for many applications including applications dealing primarily with speech data. The down-sampler comprises a weight matrix calculator and a loop in which the system takes the input data from the producer's data stream, and at one chunk at a time, the system generates the output data. The loop comprises an input receiver, a chunk receiver, an output chunk generator, a chunk decider for deciding whether there is another chunk in the input, and an input decider for deciding whether there is more input.

19 Claims, 3 Drawing Sheets

FIG. 4

| | 1 | 2 | 3 | 4 | 5 | ...L |
|---|---|---|---|---|---|---|
| 1 | $W_{11}$ | $W_{12}$ | 0 | 0 | 0 | |
| 2 | 0 | $W_{22}$ | $W_{23}$ | 0 | 0 | |
| 3 | 0 | 0 | $W_{33}$ | $W_{34}$ | 0 | |
| 4 | 0 | 0 | 0 | $W_{44}$ | $W_{45}$ | |
| 5 | 0 | 0 | 0 | 0 | $W_{55}$ | |
| 6 | 0 | 0 | 0 | 0 | 0 | |
| ...L' | | | | | | |

FIG. 5

| | 1 | 2 | 3 | 4 | 5 | 6 | 7 | 8 | 9 | 10 | 11 |
|---|---|---|---|---|---|---|---|---|---|---|---|
| 1 | 0.73 | 0.27 | 0 | 0 | 0 | 0 | 0 | 0 | 0 | 0 | 0 |
| 2 | 0 | 0.45 | 0.55 | 0 | 0 | 0 | 0 | 0 | 0 | 0 | 0 |
| 3 | 0 | 0 | 0.18 | 0.73 | 0.09 | 0 | 0 | 0 | 0 | 0 | 0 |
| 4 | 0 | 0 | 0 | 0 | 0.64 | 0.36 | 0 | 0 | 0 | 0 | 0 |
| 5 | 0 | 0 | 0 | 0 | 0 | 0.36 | 0.64 | 0 | 0 | 0 | 0 |
| 6 | 0 | 0 | 0 | 0 | 0 | 0 | 0.09 | 0.73 | 0.18 | 0 | 0 |
| 7 | 0 | 0 | 0 | 0 | 0 | 0 | 0 | 0 | 0.55 | 0.45 | 0 |
| 8 | 0 | 0 | 0 | 0 | 0 | 0 | 0 | 0 | 0 | 0.27 | 0.73 |

REAL-TIME DOWN-SAMPLING SYSTEM FOR DIGITAL AUDIO WAVEFORM DATA

BACKGROUND OF THE INVENTION

1. Field of the Invention

The present invention relates to processing digital data and more particularly to real time format conversion of digital audio waveform data.

2. Description of the Prior Art

As computers have become increasingly integrated into our culture, they have become intertwined with several existing technologies dealing with audio media. Computers are already prominent, or are becoming prominent, in telephony systems, radio systems, and speech interfaces to many types of devices. As a result, digital audio data has become much more common, and processing it efficiently has become an important issue.

An important problem that faces digital audio applications is that many of the subsystems from which such applications are constructed operate on different audio data formats. Although audio format conversion is a well-understood area, most conversions are accomplished off-line, with an emphasis on highly accurate conversion rather than on conversion speed. In modern digital audio systems, where many audio sources are real-time and produce transient data, off-line format conversion is not always acceptable. Some systems require "on the fly" format conversion, with the process completing within real-time constraints.

The traditional technique for down-sampling digital waveform data is described in various well-known sources, such as Oppenheim, A. and Schafer, R., *Discrete-Time Signal Processing,* Prentice-Hall, 1989, p.101–112. This technique involves creating a discrete-time Fourier transform model of the audio signal and operating on it. Such a mechanism is favorable when a highly faithful down-sampling is required, but can be quite slow. In order to speed the process up to real-time speeds, a Fourier model with very few terms must be used. Although this may be acceptable for certain highly tonal (or cyclical) data sets, Fourier models with few terms are inaccurate models of speech and other complex waveforms. Thus, in the traditional system, the number of terms in the model provides a trade-off between speed and accuracy, and at the speeds required for real-time conversion, the accuracy becomes unacceptable for many types of data.

SUMMARY OF THE INVENTION

The present invention is a new down-sampling system for digital waveforms. The system is fast enough to use in real-time, "on the fly" conversions and results in data of acceptable quality for many applications, including applications dealing primarily with speech data.

Typically, the down-sampler of the present invention is located between an digital waveform producer and a digital waveform consumer. The down-sampler receives an input digital audio stream from the audio data producer and down-samples the data as it arrives. The output of the down-sampler is a down-sampled digital audio stream.

The down-sampler comprises a weight matrix calculator where a weights matrix needed for the down-sampling is calculated. Next a loop begins in which the system takes the input data from the producer's data stream, and at one chunk at a time, the system generates the output data. The loop comprises an input receiver, a chunk receiver, an output chunk generator, a chunk decider for deciding whether there is another chunk in the input, and an input decider for deciding whether there is more input. If there is not more input, the conversion is completed and the down-sampler of the present invention terminates. The generation of the weights matrix and the generation of the output data are critical parts of the invention.

BRIEF DESCRIPTION OF THE DRAWINGS

FIG. 4 illustrates part of a hypothetical weight matrix.

FIG. 5 illustrates an example of a real weight matrix.

DETAILED DESCRIPTION OF THE INVENTION

Figure 1:
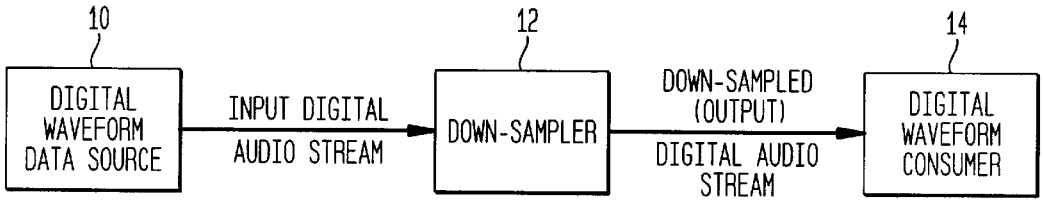
FIG. 1 illustrates utilization of the present invention in a typical system architecture.

FIG. 1 shows the utilization of the present invention in a typical system architecture. The down-sampler 12 of the present invention is located between a digital waveform data source 10 such as an audio data producer, and a digital waveform consumer 14. The down-sampler 12 receives an input digital audio stream from the digital waveform data source 10 and down-samples the data as it arrives. The output of the down-sampler 12 is a down-sampled digital audio stream. This is forwarded to the digital waveform consumer 14.

Figure 2:
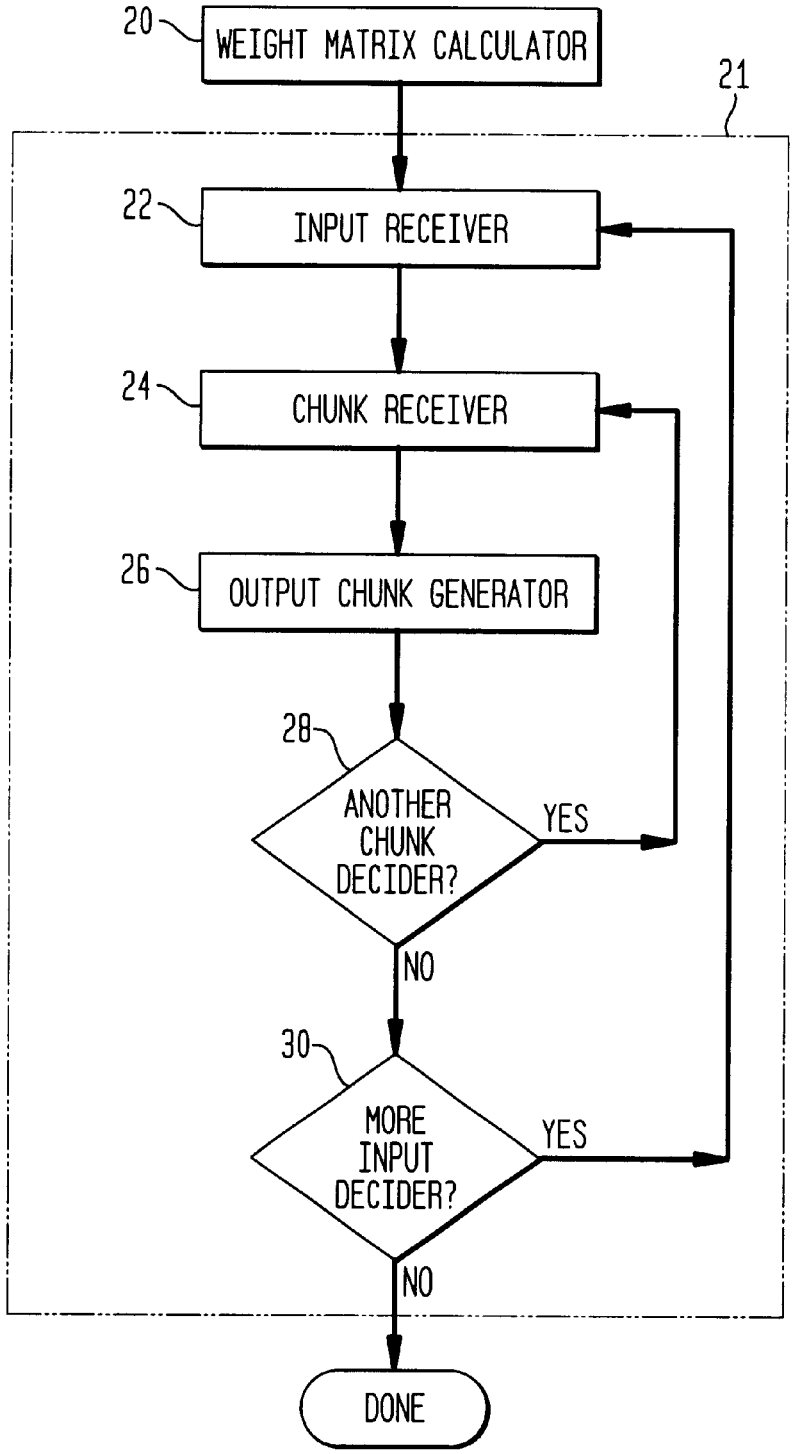
FIG. 2 illustrates a flow diagram of the real-time down-sampling system of the present invention

FIG. 2 shows a flow diagram of the real-time down-sampling system of the present invention. The down-sampler comprises a weight matrix calculator 20 where a weights matrix needed for the down-sampling is calculated. Next a loop 21 begins in which the system takes the input data from the producer's data stream, and at one chunk at a time, the system generates the output data. The loop 21 comprises an input receiver 22 that receives the input data from the data stream. A chunk receiver 24 is connected to the input receiver 22 and gets the next chunk from the input data stream. An output chunk generator 26, connected to the chunk receiver 24, generates an output chunk, and passes it to the digital waveform consumer 14. A chunk decider 28, connected to the output chunk generator 26 and the chunk receiver 24, decides whether there is another chunk in the input. If there is another chunk in the input, the loop 21 returns to the chunk receiver 24. If there is not another chunk in the input, the loop 21 flows to an input decider 30. The input decider 30, connected to the chunk decider 28 and the input receiver 22, decides whether there is more input. If there is more input, the loop returns to the input receiver 22. If there is not more input, the conversion is completed and the down-sampler of the present invention terminates. The generation of the weights matrix and the generation of the output data are critical parts of the invention.

The present invention operates under the realization that sampling rates of speech data can be rounded off to the nearest kHz without undue effect on the resulting quality. Typical sampling rates for digital audio data are 44100 Hz, 22050 Hz, 11025 Hz, and 8000 Hz. For example, in the case 22050 Hz, there are 22050 samples played in each second. If only the first 22000 samples are played in one second, and the last fifty samples are pushed to the next second (not dropped), then temporal distortion is 0.2%, which is essentially unnoticeable. The distortion for 44100 Hz and 11025 Hz is the same as for 22050 Hz, and there is no distortion for 8000 Hz data.

The present invention therefore concentrates on small "chunks" of data. These chunks are of length L, where L is the sample rate in kHz after round off. For example, the chunk size for 11025 Hz would be 11. Each chunk in the original data is used to generate a chunk of equivalent temporal duration in the output data. The chunk size of the output data, L', is the desired sample rate in kHz after round-off. Thus, a chunk of eleven samples of eleven kHz data lasts for 1/1000 of a second, just as a chunk of eight samples of eight kHz data does. Since the chunks have exactly the same duration, any error produced in the down-sampling of the chunk is strictly local and there is no cumulative error across many chunks.

Given a chunk of size L which needs to be down-sampled to a chunk of size L', each sample in the output chunk is constructed by taking a weighted average of all of the samples in the original chunk which overlap its duration. The weights for each input sample's contribution can be calculated based on the amount of temporal overlap between the segments. The calculation of the weights is described below. Each sample in the output chunk can be calculated directly as a linear combination of the contributing input samples.

Figure 3:
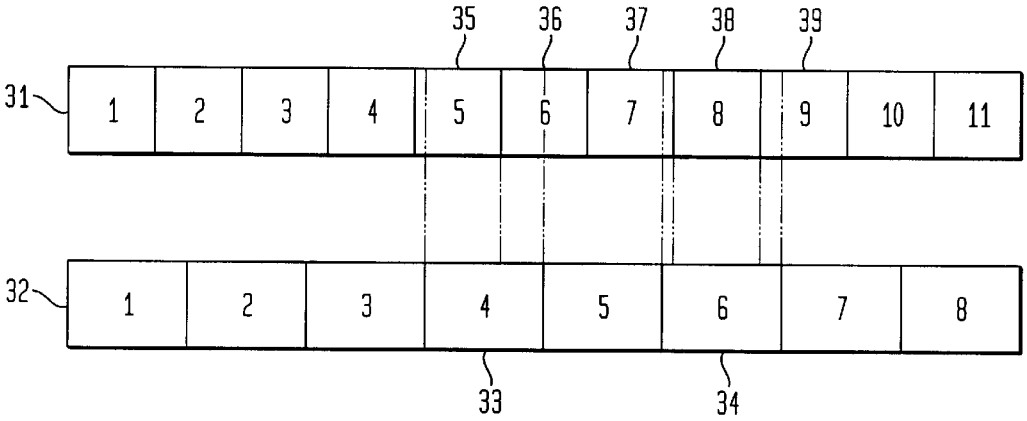
FIG. 3 illustrates an overlap between samples of an input of eleven KHz and an output of eight KHz.

FIG. 3 demonstrates the overlap between the samples in the input and output chunk, given an input 31 of eleven kHz and an output 32 of eight kHz. Note that sample four 33 in the output will draw from samples five 35 and six 36 in the input 31, and that sample six 34 in the output will draw from samples seven 37, eight 38 and nine 39 in the input.

All of the weights for calculating each of the samples in the output chunk need only be calculated once. Then, since all of the chunks have the same internal temporal structure, the calculation of each chunk in the data can reuse the same weights. The process of down-sampling the entire data stream is simply the repeated application of the weighted formulas to each chunk in turn. Chunks can be handled in whatever quantity they are produced, as long as the computer is fast enough to convert a single chunk in less time than the chunk's duration (one ms). Most modern computers are fast enough to meet this condition.

The following will describe the present invention in detail. The contribution that each input sample provides to each output sample in a chunk can be considered as an L×L' weight matrix, W. The amplitude for each sample $A_j$ in the output chunk can be calculated as the linear combination of each $A'_I$ in the input chunk, multiplied by the corresponding matrix element $W_{ij}$, as in:

$$A_j = W_{1j}A'_1 + W_{2j}A'_2 + W_{3j}A'_3 + \ldots + W_{Lj}A'_L \quad (1)$$

For example, in FIG. 3, $A_1$ would be the amplitude of the first sample in the output chunk. $A_1$ could be calculated by applying the weight $W_{1,1}$, to the input sample $A'_1$, the weight $W_{1,2}$ to the input sample $A'_2$, and so on for each input sample, and then adding the products. Note that $W_{1,3}$, through $W_{1,11}$, are zero, since input samples $A'_3$ through $A'_{11}$ do not temporally overlap with output sample $A_1$.

Each $W_{ij}$ can be calculated as a function of i,j,L and L'. Intuitively, if the sample $A_i'$ has no temporal overlap with the sample $A_j$, then $W_{ij}$ =0. If $A'_i$ does overlap with $A_j$, then $W_{ij}$ is the fraction of the original which overlaps, times the ratio of chunk sizes L'/L. For example, in the case of sample $A_1$ in FIG. 3, $A'_1$ is completely overlapped by $A_1$, so $W_{1,1}$ would be 1.0*8/11=0.73. As 36% of $A'_2$ overlaps with $A_1$, $W_{,1,2}$ would be 0.36*8/11=0.27. A weight matrix might look something like the one shown in FIG. 4.

Determining the amount of overlap between $A'_i$ and $A_j$ is accomplished by comparing the temporal endpoints of the samples. Informally, if the endpoints of sample $A'_i$ fall entirely outside the endpoints of $A_j$, then the overlap is zero. Otherwise, the amount of $A'_i$ which overlaps $A_j$ can be determined as the ratio of the overlap duration to the duration of $A'_i$ (which is 1/L). The calculation of the overlap duration varies depending on the direction of the overlap, but for example, in FIG. 3, the overlap between sample $A_4$ and sample $A'_6$ can be calculated as j/L'−(i−1)/L, or 4/8−5/11=0.045. The amount A'6 that overlaps $A_4$ is thus 0.045/(1/11)=36%. Since $W_{ij}$ in this case is ((j/L'−(i−1)/L)/1/L) *L'/L, an L term cancels out, and the final formula can be simplified.

More formally, $W_{ij}$ can be defined with five cases:

$$W_{ij} =$$

$$0 \text{ if } i/L <= (j-1)/L' \quad (1)$$

$$[(i/L)-((j-1)/L')]*L' \text{ if } i/L > (j-1)/L' \text{ and } i/L < j/L' \text{ // } A'_i \text{ ends within } A_j \text{ and Not } [((i-1)/L > (j-1)/L') \text{ // } A'_i \text{ doesn't start within } A_j \text{ and } ((i-1)/L < j/L')] \quad (2)$$

$$L'/L \text{ if } i/L > (j-1)/L' \text{ and } i/L < j/L' \text{ // } A'_i \text{ ends within } A_j \text{ and } (i-1)/L > (j-1)/L' \text{ and } (i-1)/L < j/L' \text{ // } A'_i \text{ starts within } A_j \quad (3)$$

$$[(j/L')-(i-1)/L)]*L' \text{ if } (i-1)/L > (j-1)/L' \text{ and } (i-1)/L < j/L' \text{ // } A'_i \text{ starts within } A_j \text{ and Not } [(i/L > (j-1)/L') \text{ // } A'_i \text{ doesn't end within } A_j \text{ and } (i/L < j/L')] \quad (4)$$

$$0 \text{ if } (i-1)/L > j/L' \quad (5)$$

Calculation of all of the weights of the weight matrix need only be performed once as long as the input and output sampling rates remain unchanged. If a system is being developed for fixed rate down-sampling, such as from 44.1 kHz to 8 kHz, the weights can be hard-coded into the system. Thus, for a data stream of any realistic length, the time cost of calculating of the weights is dominated by the time cost of the down-sampling itself.

An example of a real weight matrix is given in FIG. 5, for down-sampling from 11025 Hz to 8000 Hz, which corresponds to the chunks shown in FIG. 2. Once the weight matrix is calculated, all of the output samples are calculated as a linear combination of the input samples using the weights, as shown in formula (1). A naive implementation would loop through an entire row of the matrix for each sample in the output chunk but this is unnecessary. Many of the terms are zero and can be skipped. An optimized strategy can be employed with the realization that the last nonzero term for $A_j$ is always the first nonzero term for $A_{j+1}$, except when the weight is exactly L'/L, in which case the following term is the first relevant term. For example in FIG. 5, after $A_1$ has been calculated using $W_{1,1}$ and $W_{1,2}$, $A_2$ can begin calculation with $W_{2,2}$, skipping $W_{2,1}$. The following loop definition shows an optimized strategy:

```
i = 1
for j from 1 to L' do
    A_j = 0
    while (W_ij > 0) do
```

-continued $$A_j = A_j + (A'_i * W_{ij})$$

$$i = i + 1$$

end while loop if $W_{(i-1)j} <> L'/L$ then end for loop

The loop described above is applied to each chunk, as fast as chunk in the input. The resulting output chunks are passed to the consumer as needed.

As stated above, the present invention addresses the problem of down-sampling digital waveform data. The present invention could, as an example, be used within a telephony system that employs a text-to-speech synthesizer engine. Such a system is described in related U.S. patent application Ser. No. 09/037,951, entitled "A System For Browsing The World Wide Web With A Traditional Telephone", assigned to the same assignee as the present invention and filed concurently with this application. Such a telephony system may have a text-to-speech synthesizer that generates waveform audio at a sampling rate of 11 kHz but have a waveform interpreter for the telephony system which understands only 8 kHz data. Since the audio generated by the text-to-speech synthesizer is transient, "on the fly" format conversion would be needed and since the application is highly interactive, no noticeable delay would be acceptable between audio generation and audio playback. Therefore, the real-time down-sampling system of the present invention is required.

The present invention describes a down-sampling system for digital waveform data which is especially appropriate for speech audio data. The system is unique in its speed in that it is fast enough to run in real-time with data which is produced at its sampling rate.

It is not intended that this invention be limited to the hardware or software arrangement, or operational procedures shown disclosed. This invention includes all of the alterations and variations thereto as encompassed within the scope of the claims as follows.

What is claimed is:

1. A real-time down-sampling system for digital audio waveform data comprising:

a weight matrix calculator for calculating a weight matrix needed for down-sampling said digital audio waveform data received from a digital waveform data source;

a loop connected to said weight matrix calculator and said digital waveform data source wherein said loop receives said weight matrix from said weight matrix calculator and input chunks of input samples from said digital waveform data source and at one chunk at a time, generates output data in chunks of down-sampled digital audio stream, further including output calculation means wherein each of said chunks of down-sampled digital audio stream is calculated as a linear combination of each of said input samples of a corresponding input chunk using weights according to $$A_j = W_{1j}AN_1 + W_{2j}AN_2 + W_{3j}AN_3 + \ldots W_{Lj}AN_L$$

where $A_j$ is amplitude of said sample of each of said output chunks:

where $AN_i$ is amplitude of said sample of each of said input chunks;

where $W_{ij}$ is a corresponding weight matrix: and where L is number of said input samples in said corresponding input chunk.

2. A real-time down-sampling system for digital audio waveform data as claimed in claim 1 wherein said loop comprises:

input receiver means connected to said weight matrix calculator for receiving said weight matrix;

chunk receiver means connected to said input receiver means for receiving said input chucks of input samples;

output chunk generator means connected to said chunk receiver means for outputting said chunks of down-sampled digital audio stream;

chunk decider means connected to said-output chunk generator means and said chunk receiver means for deciding whether there are additional chunks and if so, sending said additional chunks to said chunk receiver means; and input decider means connected to said chunk decider means and said input receiver means for deciding whether there are more inputs and if so, forwarding said more inputs to said input receiver means.

3. A real-time down-sampling system for digital audio waveform data as claimed in claim 2 wherein said output chunk generator means comprises:

generation means for using each of said input chunks to generate output chunks with each of said output chunks having an equivalent temporal duration in output data.

4. A real-time down-sampling system for digital audio waveform data as claimed in claim 2 wherein said output chunk generator means comprises:

construction means wherein given a chunk of size L which needs to be down-sampled to a chunk of size L', each of said output chunks is a weighted average of all samples of said input chunks and overlap each of said input chunks duration where L is a number of samples in each of said input chunks and L' is a number of samples in each of said output chunks.

5. A real-time down-sampling system for digital audio waveform data as claimed in claim 2 wherein said output chunk generator means uses a linear combination to generate said output chunks.

6. A real-time down-sampling system for digital audio waveform data as claimed in claim 2 wherein said output chunk generator means comprises:

an output calculation means wherein each of said output samples in said output chunks is calculated as a linear combination of each of said input samples of said input chunks using weights for each input sample's contribution based on amount of temporal overlap between samples.

7. A real-time down-sampling system for digital audio waveform data as claimed in claim 1 wherein each of said input chunks and each of said output chunks have same duration.

8. A real-time down-sampling system for digital audio waveform data as claimed in claim 7 wherein each of said input chunks is of length L' where L is a rounded sample rate and each of said output chunks is of length L', where L' is a desired rounded sample rate.

9. A real-time down-sampling system for digital audio waveform data as claimed in claim 1 wherein said loop comprises:

application means for applying a weighted formula to each of a plurality of input chunks in turn repeatedly.

10. A real-time down-sampling system for digital audio waveform data as claimed in claim 1 wherein said weight matrix calculator comprises:

calculation means for calculating weights for each of said output chunks.

11. A real-time down-sampling system for digital audio waveform data as claimed in claim 1 wherein said weight matrix calculator comprises:

caculation means for calculating wieghts for each input sample's contribution based on amount of temporal ovelap between samples.

12. A real-time down-sampling system for digital audio waveform data as claimed in claim 1 wherein said weight matrix calculator comprises:

calculation means for calculating all weights of a weight matrix only once as long as input and output sampling rates remain unchanged and recalculating a weight matrix when said input and output sampling rates change.

13. A method of performing real-time down-sampling for digital audio waveform data comprising the steps of:

calculating a weight matrix needed for down-sampling a digital audio stream received from a digital waveform data source;

utilizing a loop for receiving said weight matrix and input chunks of input samples from said digital waveform data source and for generating output data in chunks of down-sampled audio data one chunk at a time; wherein said step of utilizing a loop comprises the steps of:

generating an output chunk;

deciding whether there is another chunk in said input samples and if so, looping said another chunk back for processing and outputting; and deciding whether there is more of said input samples and if so, looping said more of said input samples for processing and outputting.

14. A method of performing real-time down-sampling for digital audio waveform data as claimed in claim 13 wherein generating an output chunk comprises the step of:

calculating each of said output samples as a linear combination of each of said input samples of a corresponding input chunk using weights according to $$A_j=W_{1j}A'_1+W_{2j}A'_2+W_{3j}A'_3+\ldots+W_{Lj}A'_L$$

where $A_j$ is amplitude of said sample of each of said output chunks;

where $A'_i$ is amplitude of said sample of each of said input chunks;

where $W_{ij}$ is a corresponding weight matrix; and where L is number of said input samples in said corresponding input chunk.

15. A method of performing real-time down-sampling for digital audio waveform data as claimed in claim 13 wherein generating an output chunk comprises the step of:

calculating each of said output samples in said output chunks by a linear combination of each of said input samples of said input chunks using weights for each input sample's contribution based on amount of temporal overlap between samples.

16. A method of performing real-time down-sampling for digital audio waveform data as claimed in claim 13 wherein calculating a weight matrix comprises the step of:

calculating weights for each input sample's contribution based on amount of temporal overlap between samples and calculating weights only once as long as input and output sampling rates remain unchanged.

17. A real-time down-sampling system for digital audio waveform data comprising:

a weight matrix calculator for calculating a weight matrix needed for down-sampling said digital audio waveform data received from a digital waveform data source;

a loop connected to said weight matrix calculator wherein said loop receives input chunks of input samples from said digital audio waveform data and at one chunk at a time, generates output data in output chunks of output samples; wherein said loop comprises:

an output chunk generator wherein each of said output samples in said output chunks is calculated as a linear combination of each of said input samples of said input chunks using weights for each input sample's contribution based on amount of temporal overlap between samples.

18. A real-time down-sampling system for digital audio waveform data as claimed in claim 17 wherein said output chunk generator comprises:

output calculation means wherein each of said output samples is calculated as a linear combination of each of said input samples of a corresponding input chunk using weights according to $$A_j=W_{1j}A'_1+W_{2j}A'_2+W_{3j}A'_3+\ldots+W_{Lj}A'_L$$

where $A_j$ is amplitude of said sample of each of said output chunks;

where $A'_i$ is amplitude of said sample of each of said input chunks;

where $W_{ij}$ is a corresponding weight matrix; and where L is number of said input samples in said corresponding input chunk.

19. A real-time down-sampling system for digital audio waveform data, comprising:

input means for receiving said digital audio waveform data and for grouping said data into time length chunks of input samples;

means for calculating a weight matrix based on one comparison of said chunk of input samples to an equivalent time length chunk of desired decimated output samples, such that each weight in the matrix represents an input sample=s contribution to an output sample based on an amount of temporal overlap between input and output samples;

means for producing decimated output chunks of said time length by calculating a linear combination of each input sample within each of said input chunks using said weight matrix; and output calculation means wherein each of said chunks of down-sampled digital audio stream is calculated as a linear combination of each of said input samples of a corresponding input chunk using weights according to $$A_1=W_1AN_1+W_2AN_2+W_3AN_3+\ldots W_LAN_L$$

where $A_i$ is amplitude of said sample of each of said output chunks;

where $AN_i$ is amplitude of said sample of each of said input chunks;

where $W_{ij}$ is a corresponding weight matrix; and where L is number of said input samples in said corresponding input chunk.

* * * * *